United States Patent [19]

Rausch

[11] 3,983,726

[45] Oct. 5, 1976

[54] GAS TANK PROTECTOR

[76] Inventor: R. W. Rausch, R.D. No. 1, Andover, Ohio 44003

[22] Filed: July 30, 1975

[21] Appl. No.: 600,406

[52] U.S. Cl. ..... 70/164

[51] Int. Cl.[2] ..... B65D 55/14

[58] Field of Search ..... 70/158, 163, 164, 166, 70/167, 168, 237

[56] References Cited

UNITED STATES PATENTS 1,599,685 9/1926 Spaeth ..... 70/164 X

*Primary Examiner*—Richard E. Moore

[57] ABSTRACT

A theft prevention device for vehicles having a side panel and a fuel tank beside the side panel. An opening through the side panel communicates with a filler cap. A hollow cup-like cylindrical member may be inserted through the side panel opening over the filler cap and a disc, larger than the opening in the side panel is pushed up behind the side panel and attached to the cap so that it can not be removed.

4 Claims, 4 Drawing Figures

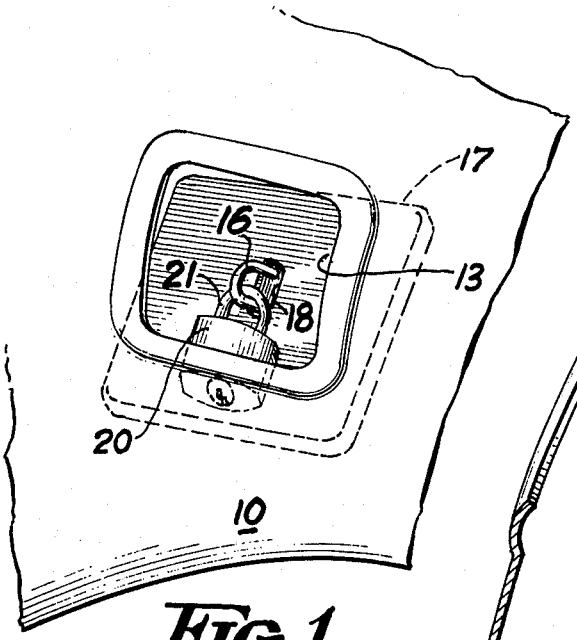
FIG. 1.
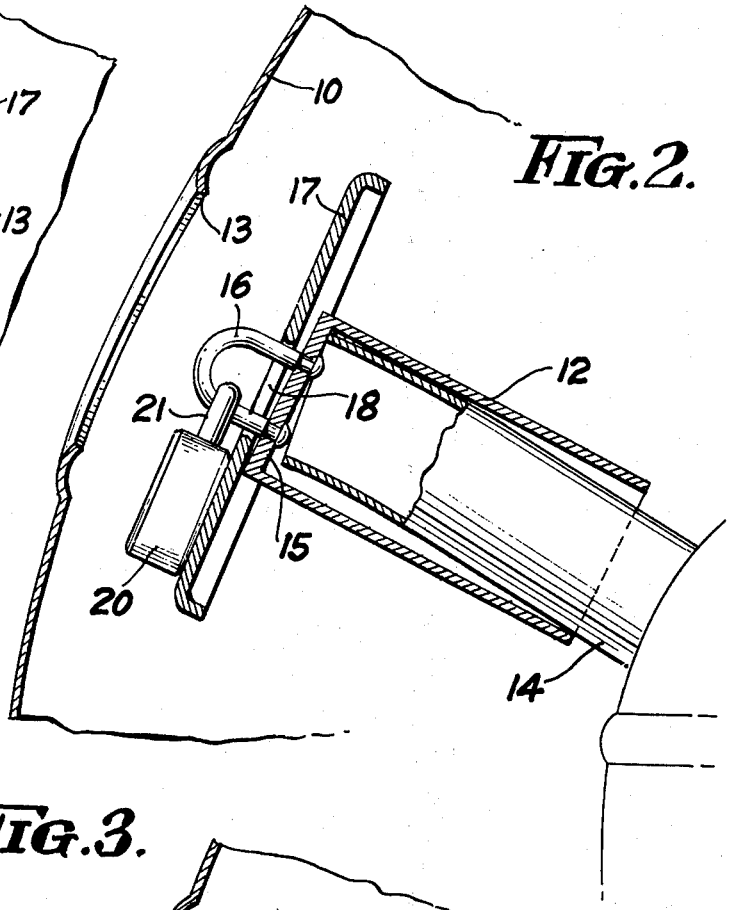
FIG. 2.
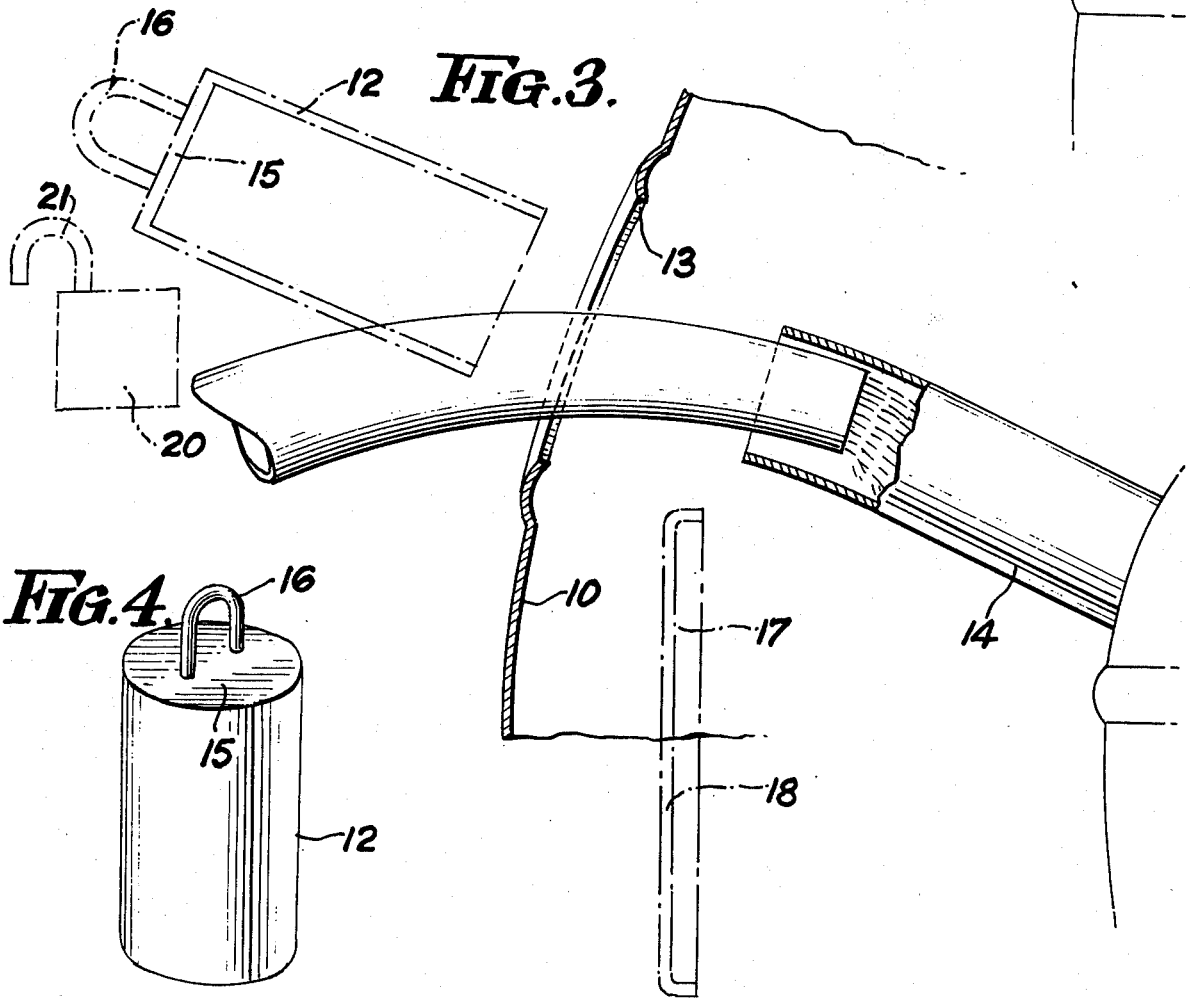
FIG. 3.
FIG. 4.

GAS TANK PROTECTOR

REFERENCE TO PRIOR ART

The invention disclosed herein constitutes an improvement over the following U.S. Pat. Nos.:

| | |
|---|---|
| 3,756,047 | 2,526,238 |
| 1,636,641 | 3,274,809 |
| 1,794,386 | 3,537,283 |
| 1,657,283 | 1,599,685 |

OBJECTS OF THE INVENTION

It is an object of the invention to provide an improved theft prevention device for fuel tanks of motor vehicles.

Another object of the invention is to provide a theft prevention device that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF DRAWING

FIG. 1 is a side view of a vehicle having the theft prevention device mounted on it.

FIG. 2 is a cross sectional view taken through the filler nozzle of the theft prevention device.

FIG. 3 is a cross sectional view taken on line 3—3 of FIG. 2.

FIG. 4 is an isometric view of the nozzle cover, according to the invention.

DETAILED DESCRIPTION OF DRAWING

The theft prevention device disclosed herein is shown mounted in a vehicle such as a truck or bus having a side panel 10 and a fuel tank 11 behind the side panel and spaced therefrom. An opening 13 is provided in the side panel. The tank has a filler tube 14 terminating in spaced relation with panel 10 and the opening in the filler tube is aligned with the opening in the panel. A hollow generally cylindrical cap 12 has a closure 15 at one end slidable over the end of the filler tube. The cylindrical cap has a length greater than the distance between the end of the filler tube and the panel 10 so that the cylinderical cap may be inserted through the opening 13 in the panel and the washer or disc can be pushed up from below the panel 10 and over the eye 16 on the cap. A padlock 20 may be locked to the eye 16 having its half 21 inserted through the eye.

Once the cap is in place on the filler tube, the operator can reach down below the panel 10 and insert the disc 18 between the panel 10 and the end of the eye 16 on the end 15 of the disc 17. The operator can then pass the half 21 of the lock 20 through the eye 16 thereby holding the eye to the disc since the cap 12 is deeper than the space between the cap and the panel 10. The disc 17 prevents a theft from pulling the cap off of the filler tube.

The foregoing specification sets forth the invention in its preferred practical forms but the structure shown in capable of modification within a range of equivalents without departing from the invention which is to be understood is broadly novel as is commensurate with the appended claims.

The embodiments of the invention in which an exclusive property or privilege is claimed and defined below:

1. In combination, a theft proof cap and a vehicle having a side panel with an opening overlying a filler nozzle, a hollow cylindrical cap closed at one end, adapted to pass through said opening in said vehicle panel supported on said filler nozzle, and, lock means on said cap holding a member to said cap preventing said cap from being pulled through said opening in said vehicle body.

2. The combination recited in claim 1 wherein said means attachable to said cap comprises a disc of flat material, larger in diameter than said opening in said vehicle body and, said cap has an eye member fixed to the closed end thereof adapted to pass through said disc and, a padlock for holding said disc to said cap.

3. The cap recited in claim 1 wherein said nozzle is spaced from said panel and said cylinder has a length greater than the distance from said nozzle to said panel.

4. The combination recited in claim 3 wherein said cap is freely slideably supported on said nozzle.

* * * * *